United States Patent [19]

Post et al.

[11] 3,985,079

[45] Oct. 12, 1976

[54] SELF-DESTRUCT FUZE FOR SPINNING ARTILLERY PROJECTILE

[75] Inventors: Lloyd D. Post, Mount Fern; William J. Holley, Sparta; Stephan Kosonocky, Whippany; John J. Dineen, Wharton, all of N.J.

[73] Assignee: The United States of America as represented by the Secretary of the Army, Washington, D.C.

[22] Filed: Oct. 20, 1975

[21] Appl. No.: 623,684

[52] U.S. Cl. ..... 102/80; 102/71

[51] Int. Cl.[2] ..... F42C 15/26

[58] Field of Search ..... 102/80, 79, 71, 76 R, 102/70 R, 76 P

[56] References Cited

UNITED STATES PATENTS

| | | | |
|---|---|---|---|
| 2,515,066 | 7/1950 | Williams et al. | 102/79 |
| 2,975,711 | 3/1961 | Brown et al. | 102/80 |
| 2,978,984 | 4/1961 | Czajkowski | 102/80 |
| 3,075,465 | 1/1963 | Craig | 102/80 X |
| 3,326,131 | 6/1967 | Hazelet | 102/79 |
| 3,726,229 | 4/1973 | Kosonocky et al. | 102/79 X |

*Primary Examiner*—David H. Brown

*Attorney, Agent, or Firm*—Nathan Edelberg; A. Victor Erkkila; Ronald M. Spann

[57] ABSTRACT

A fuze device to self-destruct a spinning projectile when the primary fuzing system, such as mechanical time fuze or point detonating fuze, fails to function. The fuze utilizes separate locking devices which are each responsive to acceleration environments that a projectile experiences in a normal launch and flight. A setback pin, double resiliently mounted detents, spin detent, armed indicator, shutter, rotor, plunger, plunger lock and sac assembly containing silicone grease pressed on by blades of the rotor combine in a mechanically complementary design which insures that this self-destruct fuze may not be assembled armed in a projectile but will fire a projectile in which it is assembled in response to terminal deceleration of the projectile.

7 Claims, 13 Drawing Figures

SELF-DESTRUCT FUZE FOR SPINNING ARTILLERY PROJECTILE

GOVERNMENTAL INTEREST

The invention described herein may be manufactured, used and licensed by or for the Government for governmental purposes without the payment to us of any royalty thereon.

BACKGROUND OF THE INVENTION

Various means have been used in prior art to fuze projectiles so that after launch the projectile will become armed and will explode on impact with a target. Prior art devices have used self-destruct means on small caliber shells; however, their time delay mechanisms have been too short for use in larger shells fired from rifled guns. Additionally, these prior art devices have not been able to reliably conform to modern safety requirements for large caliber shells.

SUMMARY OF THE INVENTION

In accordance with the present invention, a spinning projectile is provided with a self-destruct fuze, which is mounted on the projectile's spinning axis and is initiated when the primary fuzing system, e.g. mechanical time fuze or point detonating fuze, fails to function. The self-destruct fuze of the present invention is designed to maintain a detonator in a "safe" locked position and is not converted into an "armed" position until such time as the projectile has cleared all launch personnel and has received the necessary amount of linear and angular acceleration. In the event that the primary fuzing system fails to explode the projectile, the self-destruct fuze will function by impact on target or by deceleration relative to the in-flight functioning of the projectile.

One of the objects of this invention is to provide a self-destruct fuze for artillery projectiles fired from a rifled gun.

Another object of this invention is to provide a self-destruct fuze for an artillery projectile which will not arm the projectile until it has seen a proper launch environment.

A further object of this invention is to provide a self-destruct fuze for use in an artillery projectile which is capable of reducing the existence of active field duds.

Another object of this invention is to provide a self-destruct fuze for use in an artillery fired projectile which will function on impact in the event that the primary fuze has failed to explode the projectile.

Another object of this invention is to prevent assembly of an armed self-destruct fuze into the projectile.

For a better understanding of the present invention, together with other and further objects thereof, reference is made to the following description taken in conjunction with the accompanying drawings.

DESCRIPTION OF THE PREFERRED EMBODIMENT

Figure 11:
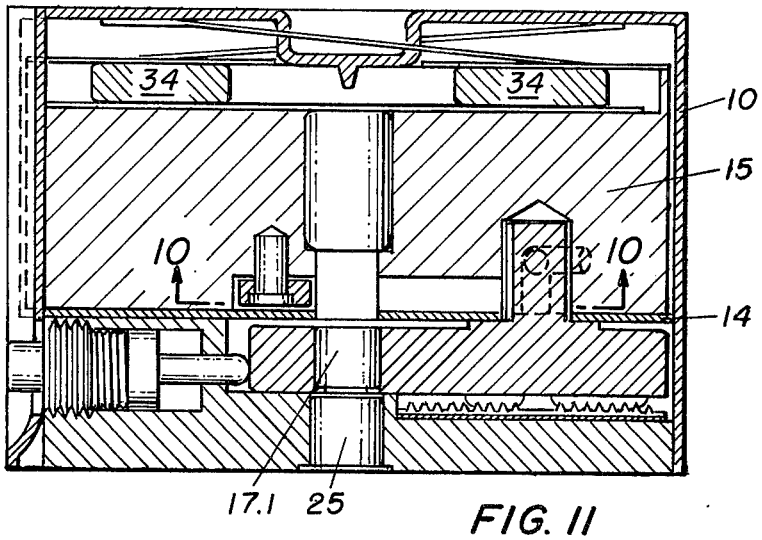
FIG. 11 is a partial cutaway side view of the self-destruct fuze in the armed position.
Figure 12:
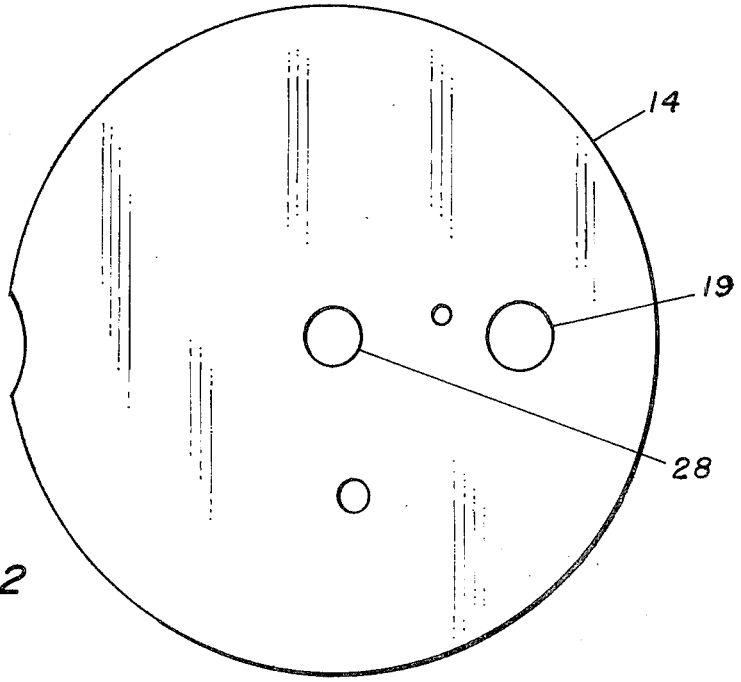
FIG. 12 is a top plan view of the plate in the self-destruct fuze.
Figure 13:
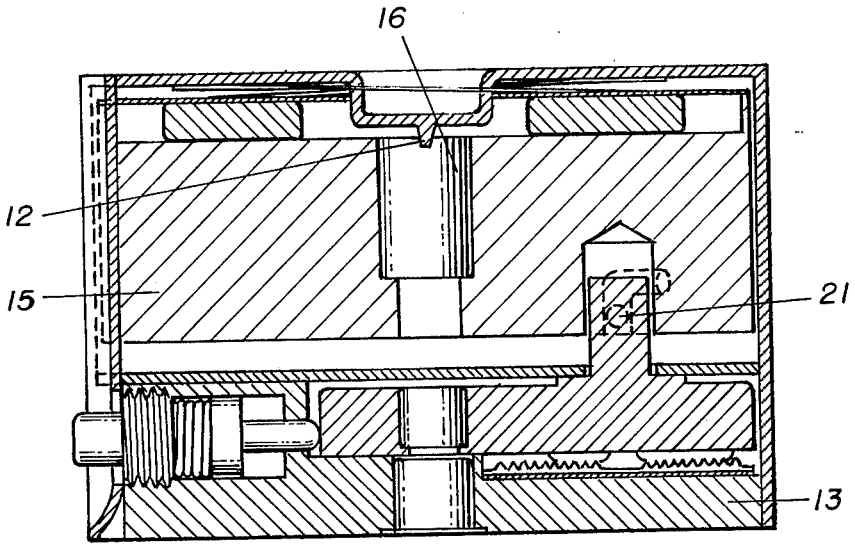
FIG. 13 is a partial side view of the self-destruct fuze in the fire position.

As shown in FIGS. 1–6, the self-destruct fuze assembly comprises a cylidrical housing 10 having a front end containing an inwardly extending cylindrical projection 11 and firing pin 12 and a rear end containing a fixed base member 13. An intermediate fixed plate 14 supports an inertial piston or plunger 15 carrying a stab delay detonator 16 axially aligned with the firing pin 12. The circumference of plunger 15 is provided with a longitudinal axial channel 15A, which mates with a corresponding indentation 10A in housing 10 to prevent rotation of the plunger relative to the housing but permit forward travel of the plunger to the firing pin. Positioned between intermediate plate 14 and base member 13 is a rotor 17 having a rotor shaft 18 extending through a bore 19 in intermediate plate 14 into a bore 20 in plunger 15. Rotor shaft 18 carries a lockpin 21, which fits and travels in the L-shaped groove 22 shown by phantom lines in plunger 15. The bottom of rotor 17 is provided with blades 23, which operatively contact a grease sac assembly 24 (containing silicon grease in a sealed plastic envelope) contained in shallow well 24A in base member 13. The latter contains a lead charge 25 axially aligned with delay detonator 16 and adjacent to booster pellet 26 in the rear end of housing 10. Holes 27 and 28 in plunger 15 and intermediate plate 14 respectively provide a passage communicating between the delay detonator 16 and the lead charge 25. In the unarmed position shown in FIGS. 1–6, this passage is interrupted by the rotor 17 and the shutter 29, which is positioned in recess 30 in plunger 15, and rotates on shaft 31 in bore 32. Shutter 29 has an arc-like contour 33 which operatively engages and locks with the flat part of the D-shaped rotor shaft 18 in the unarmed position and disengages said shaft in the armed position. Delay detonator 16 is spaced from firing pin 12 by detents 34 positioned between cylindrical projection 11 and plate 35 on plunger 15. Detents 34 have the configuration shown by phantom lines in FIG. 5, pivot on shafts 36 journaled in plate 35 and are biased by leaf springs 37. A spring 38 is positioned between the front end of housing 10 and plate 39 on rim 40 of plunger 15 and presses against plunger 15 sufficiently so that when detents 34 are caused to move by projectile spin to the armed position shown in FIGS. 11 and 13, the plunger cannot move forward to strike the firing pin until terminal deceleration of the projectile is reached, see FIG. 13. Each of the plates 35 and 39 has a central opening sufficient to permit passthrough of the cylindrical projection 11.

Figure 1:
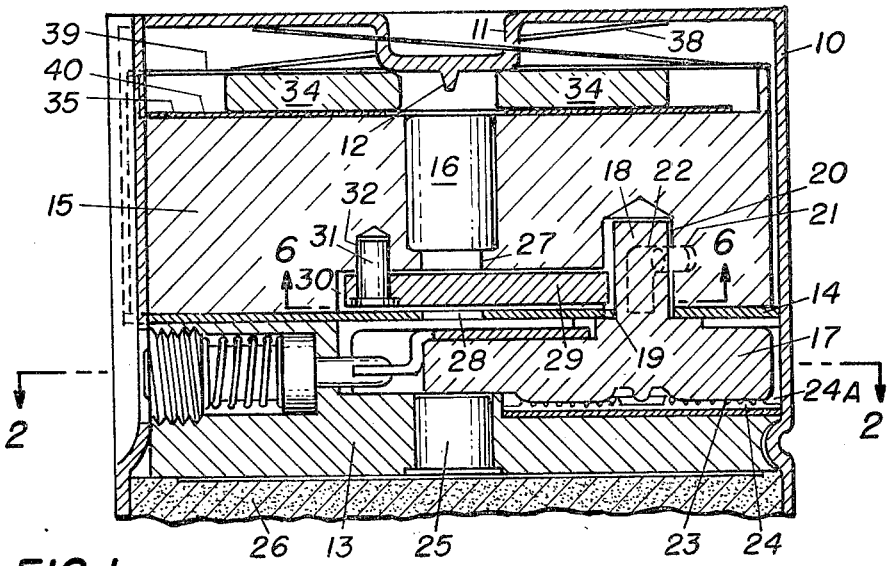
FIG. 1 is a cross section detail of the self-destruct fuze in the unarmed configuration.
Figure 2:
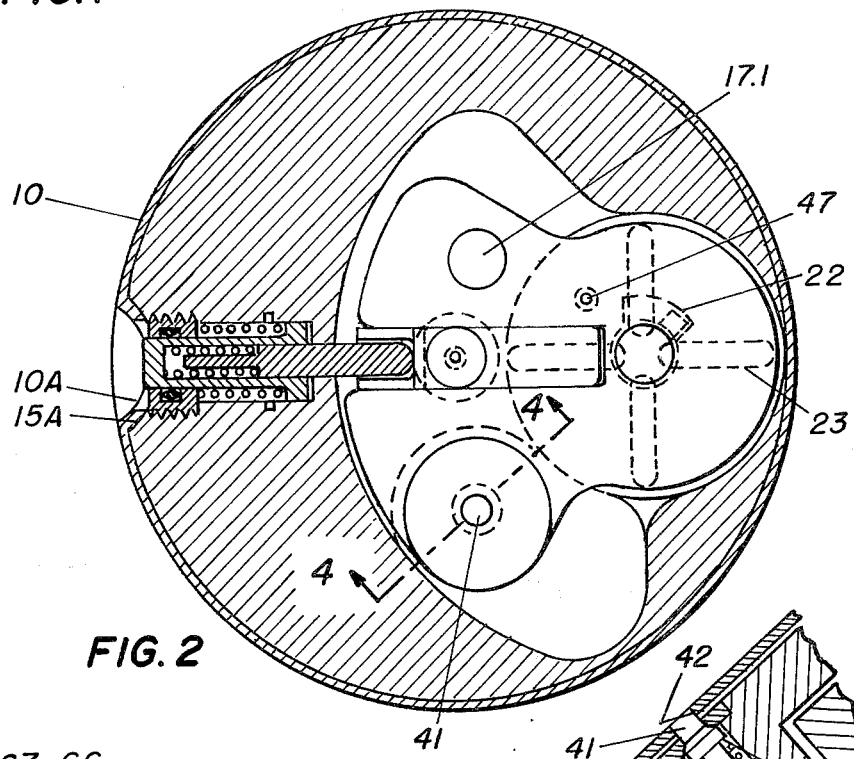
FIG. 2 is a partial cutaway, when viewed along line 2—2 of FIG. 1 from the top, plane section view of the self-destruct fuze showing the spin detent and arming indicator, slider, rotor, rotor blades (by phantom lines), and L-shaped slot by phantom lines in the unarmed position.
Figure 3:
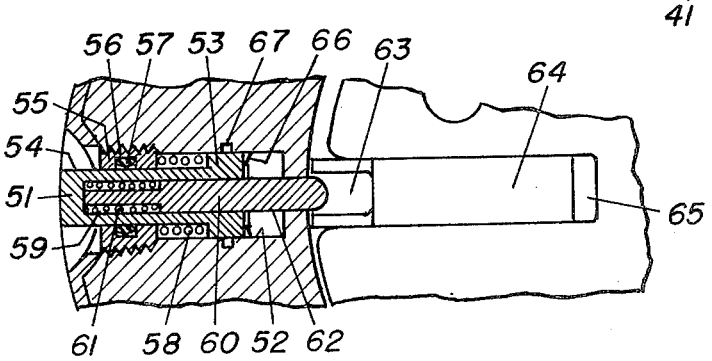
FIG. 3 is a partial cutaway, top plan view of the spin detent, arming indicator and slider in the unarmed position.
Figure 4:
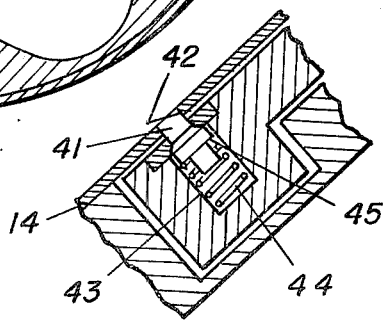
FIG. 4 is a cross section detail of the setback pin in the unarmed position.
Figure 5:
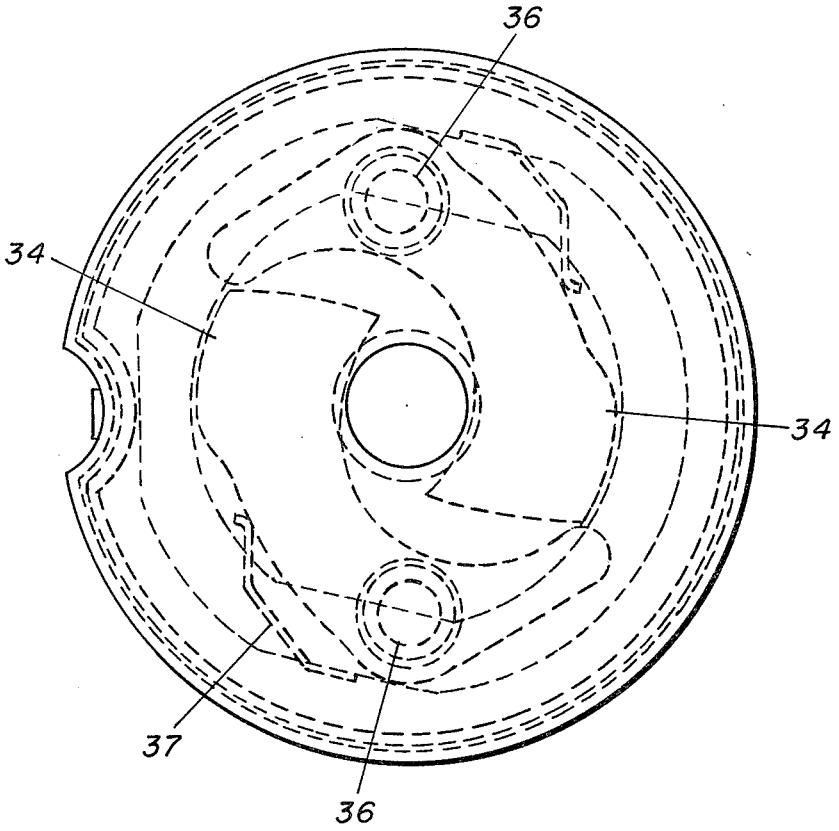
FIG. 5 is a partial cutaway, top plan view of the self-destruct fuze in an unarmed position showing in dotted outline form or phantom lines both detents swung radially inward such that they both physically prevent the plunger from moving toward the firing pin.
Figure 6:
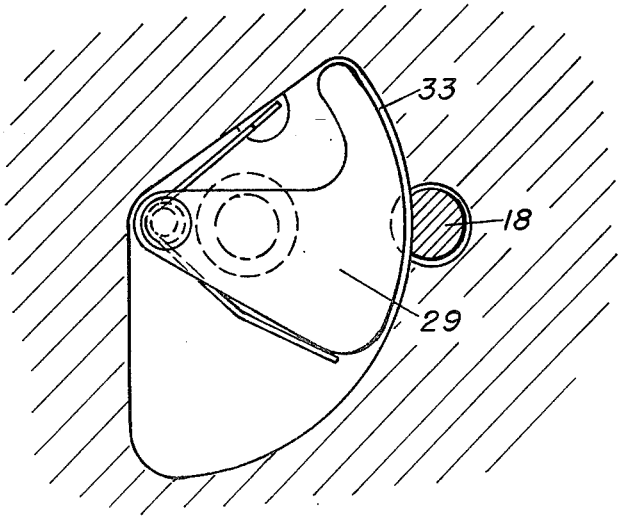
FIG. 6 is a partial top view of the self-destruct fuze showing the shutter in the unarmed position and engaging the "D" shaped rotor shaft of the rotor.
Figure 7:
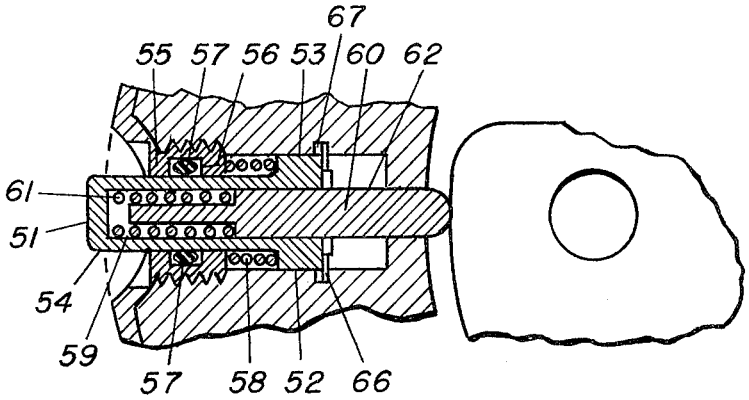
FIG. 7 is a partial cutaway, top plan view of the self-destruct fuze, outside the projectile, with the indicator and spin detent no longer engaging the rotor slider or rotor.
Figure 8:
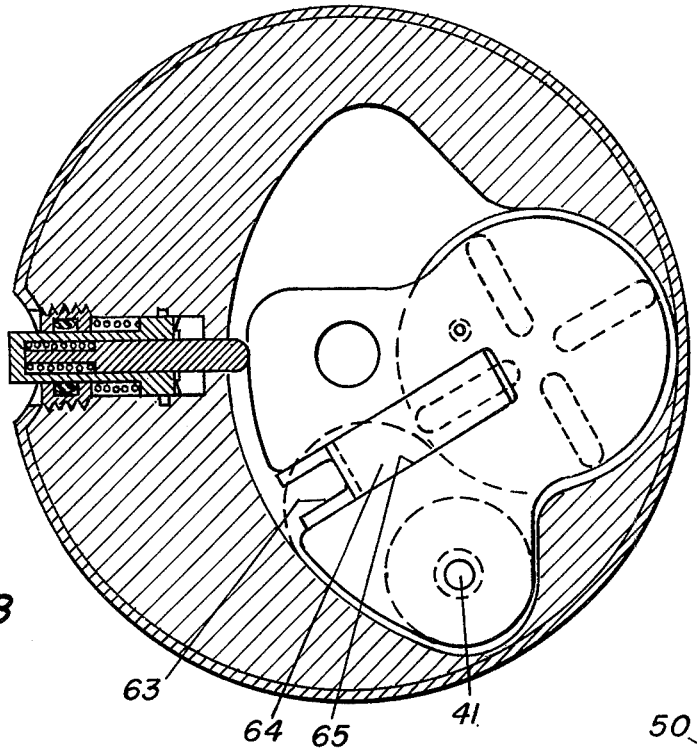
FIG. 8 is a partial top view of the self-destruct fuze when in the projectile but armed.
Figure 9:
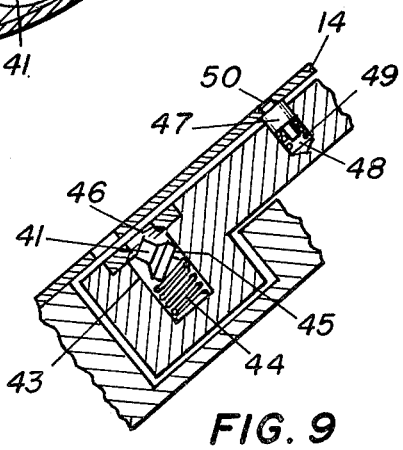
FIG. 9 is a side view of the setback pin and rotor lock when the self-destruct fuze is armed.
Figure 10:
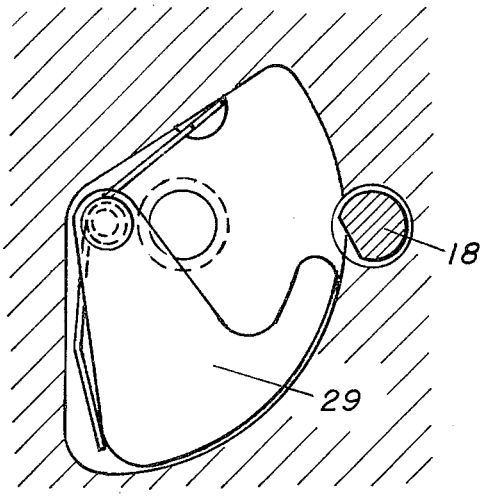
FIG. 10 is a partial top view of the shutter and D-shaped rotor shaft when the self-destruct fuze is armed.

Rotor 17 is held in the unarmed position by a setback pin 41 projecting into hole 42 in intermediate plate 14 (FIG. 4). The setback pin is biasedly positioned in cavity 43 by coil spring 44, which engages the collar 45 of pin 41 only on one side so that when the spring 44 is compressed by setback force, the pin is withdrawn from plate 14 into cavity 43, thereby causing the pin to tilt and become permanently caught against the narrow cavity mouth 46 (FIG. 9). Rotor 17 also contains a M55 detonator relay 17.1 and a rotor lock pin 47 biasedly positioned in cavity 48 by coil spring 49. When rotor 17 turns in response to projectile spin, pin 47 projects into hole 50 in intermediate plate 14, thereby locking the rotor in armed position (FIGS. 7–11) and the M55 detonator relay 17.1 is axially aligned with the delay detonator 16.

To prevent accidental arming by jolting and to remove the possibility of assembling an armed self-destruct unit into the round, the fuze is provided with a spin detent and arming indicator assembly (refer particularly to FIGS. 2–3 and 7–8), which comprises a cylindrical, spring biased indicator piston 51 slidably mounted in radial bore 52 in fuze base member 13. Indicator piston 51 consists of a wide diameter end 53 fitting in bore 52 and a narrow diameter end 54 slidably mounted in annular nut 55, which is threadedly held in the mouth of bore 52 aligned with an opening in the longitudinal indentation in housing 10. Nut 55 has a channel 56 containing an O-ring 57, which provides a tight seal with the narrow diameter of the piston. Indicator piston 51 is biased by a coil spring 58 situated in the space between the wide diameter piston end 53 and nut 55. The piston 51 has a longitudinal axial bore 59 containing a slidable cylindrical detent pin 60, which is biased by detent spring 61 pressing against the closed end of piston bore 59 and the axially shouldered rear end of the detent pin. The forward end of detent pin 60 passes through a narrow bore 62 in the wide end 53 of indicator piston 51 and projects into mating slot or member 53 in slider 64 slidably positioned in channel 65 in rotor 17. An annular snap washer 66 is mounted in the wide diameter rear end of piston 51, and engages a circumferential slot 67 in the wall of bore 52 in base member 13 when the indicator piston is in armed out of round position shown in FIG. 7.

The following is a description of the functioning sequence of the self-destruct fuze schematically represented in FIGS. 1–13.

The launching acceleration depresses the setback pin 41 which is mounted in the rotor 17 and disengages from the plate 14 when depressed. The setback pin 41 is tilted by the spin and cannot re-engage the plate 14 after setback. The spin detent portion 60 of safe/arm indicator which engages the slider 64 and locks the rotor 17, is driven by spin into a disengaged position away from the rotor 17 while the slider 64 stays with the rotor 17. The shutter 29 which interlocks with the D-shaped rotor shaft 18 is also driven by spin into an armed position and disengages the D-shaped shaft interlock. The spin also arms the plunger detents 34. The centrifugal force now drives the rotor 17 into the armed position. This arming motion is resisted and delayed by the restraining force due to the viscosity of the silicone grease sac assembly 24 bearing on the four rotor blades 23. An arming time delay results from the interaction of centrifugal force and silicone sac restraining force. This delay provides a corresponding safe separation distance of the projectile from the launching weapon.

When the rotor reaches the armed position, the lock pin 21 on the end of the rotor shaft is disengaged from the L-shaped groove 22 in the plunger 15 and this constraint on the plunger 15 is removed. The plunger 15 is now capable of moving in response to the deceleration exceeding the plunger spring 38 force level. The spring biased rotor lock pin 47 locks the rotor 17 when the armed position is reached This eliminates the possibility of disarming of the rotor 17 and re-engagement of the plunger 15 by rotor lock pin 21 in the L-shaped groove 22. The D-shaped rotor shaft 18, when in the armed position, interferes with radial contour 33 of the shutter 29 and, therefore, shutter 29 remains armed when the rotor 17 is armed. By arming the rotor 17 and shutter 29, two barriers between the delay detonator 16 and the lead pellet 25 are removed and delay detonator 16, M55 relay detonator 17.1 and lead 25 are brought in axial alignment.

When the terminal deceleration of the projectile takes place, inertia causes the plunger 15 to move forward. This brings the detonator 16 in contact with the firing pin 12 resulting in detonator 16 initiation. The functional deceleration can be due either to the in-flight ejection of the submunitions cargo or to ground impact. In case of submunitions in-flight ejection, which is the normal mode of round functioning, the functioning of the self-destruct unit takes place after a delay due to delay detonator 16 when the cargo has dispersed and it is not affected by the self-destruct booster pellet 26 detonation. In case of the projectile ground impact, as the consequence of the primary fuzing failure, the detonation of the self-destruct booster pellet 26 destroys the closely packed round cargo by inducing sympathetic detonation of the explosives.

The function of the arming indicator and spin detent 60, as part of the arming indicator assembly, in addition to locking the rotor 17, is to remove the possibility of assembling an armed self-destruct unit into the round. If the rotor is armed outside of the round, the indicator 51 projects outside the cylindrical contour of the unit and locks in this position. There is a visual display of the armed condition and an interference preventing the assembly of an armed unit into the cylindrical space in the round. In the safe condition, the spin detent 60 engages the slider 64 which is mounted in the rotor 17. If a lateral impact force drives the spin detent 60 outward, the slider 64 is also driven in the same direction and the locking of the rotor 17 is maintained. In a ballistic environment, the spin of the projectile drives the spin detent 60 away from the rotor 17 and retains the slider 64 in its previous (safe) position in respect to the rotor 17. The spin arming of the detent 60 is accompanied by an outward displacement of the indicator 51 until it contacts the wall of the shell cavity. If the rotor 17 has armed prior to insertion in the shell cavity, the indicator 51 is pushed further out by the detent spring 61 which is stronger than the indicator spring 58. The snap washer 66 locks the indicator 51 in this position permanently and an armed self-destruct unit cannot be placed into the shell.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

We claim:

1. A self-destruct fuze adapted to function on a spinning artillery projectile on terminal deceleration of the projectile when the primary fuze, such as a mechanical time fuze, fails to function, which comprises:

a housing comprising a front end having an inwardly projecting firing pin means and a rear end base member having positioned therein a lead charge and a booster charge;

a plunger means positioned in said housing;

a stab detonator positioned in said plunger and aligned with said firing pin;

a means to prevent rotation of the plunger relative to the housing;

a spin actuated rotor means positioned intermediate said plunger means and said base member and having an integral pivot member positioned in a cavity in the rear end of said plunger means;

a lock pin mounted on said rotor pivot member;

an L-shaped groove in said plunger cavity to slidably receive said lock pin for holding said plunger in the unarmed position and releasing the plunger means in the armed position;

a passage including an opening in each of said plunger means and rotor means communicating with said detonator and lead charge when said rotor is in the armed position but not when the rotor means is in the unarmed position;

a spin activated shutter means having a pivot member positioned in a cavity in said plunger means and being biasedly positioned intermediate said plunger means and rotor means for closing said passage communicating between said detonator and lead charge in the unarmed position and opening said passage in the armed position;

a rotor retarding means for slowing the rotation of the spin driven rotor from the unarmed to the armed position;

a spin-activated detent means biasedly positioned intermediate said firing pin means and plunger means for releasably holding said plunger means from operative contact with said firing pin means in the unarmed position;

a rotor spin detent means positioned in said base member for releasably engaging the rotor means in the unarmed position;

a plunger biasing means for preventing said detonator from operatively contacting said firing pin means in the armed position until the projectile deceleration force exceeds that of said biasing means.

2. The fuze according to claim 1, wherein the shutter has an arc-like contour which slidably engages a mating surface on said rotor pivot member during a part of its travel, whereby the shutter means is held in the armed position by interference of said arc-like contour with the mating surface of the shaped rotor shaft when said rotor pivot means has rotated to its armed position.

3. The fuze according to claim 1, wherein the rotor retarding means comprises a grease sac assembly including blades mounted on the rotor means and pressing on the sac of viscous grease contained in said housing base.

4. The fuze according to claim 1, including a setback locking means for holding said rotor means in the unarmed position and releasing said rotor means on setback to achieve the armed position, said setback locking means including a spring biased pin positioned in a cavity of said rotor means and extending into a mating cavity in an adjacent fixed plate and tilted by the projectile spin to engage a projection in said cavity, whereby the pin is prevented from re-engaging said plate after setback subsides and the projectile continues spinning.

5. The fuze according to claim 1, wherein said rotor means contains a spring biased locking pin for engaging a cavity in said fixed plate and holding the rotor means in the armed position.

6. The fuze according to claim 1, wherein the rotor spin detent means comprises:

a radial bore in said housing base member;

a cavity in said rotor means aligned with said radial bore;

an arming indicator including a piston slidably positioned in said radial bore and biased toward the rotor means, and a spin detent pin slidably contained in a bore of the piston and biased toward the rotor means;

a slider in said rotor cavity having a mating member for releasably engaging said detent pin;

whereby the detent pin engages the slider in the unarmed position so that (1) a lateral impact force drives both the detent pin and slider outward in the same direction, thereby maintaining detenting of the rotor means; and (2) projectile spin causes an outward displacement of the arming indicator piston and inward displacement of the slider until the detent pin disengages the slider and rotor means to achieve the armed position.

7. The fuze according to claim 6, wherein a snap washer is mounted on said indicator piston for engaging a slot in the wall of said base member bore, and the detent pin is biased more strongly than the arming indicator piston, whereby when the rotor means is armed prior to insertion into the projectile cavity, the indicator piston is biased to extend outside the fuze housing and the indicator piston is locked in such position by engagement of said snap washer and slot, thereby preventing insertion of the armed fuze into the projectile cavity.

* * * * *